US006082700A

United States Patent [19]

Lancelot, III et al.

[11] Patent Number: 6,082,700

[45] Date of Patent: Jul. 4, 2000

[54] ANCHOR POSITIONING INSERT

[75] Inventors: Harry Bailey Lancelot, III, Hurst; Larry Gene Vines, Burleson, both of Tex.

[73] Assignee: Dayton Superior Corporation, Miamisburg, Ohio

[21] Appl. No.: 09/213,211

[22] Filed: Dec. 17, 1998

[51] Int. Cl.[7] ..... E04G 15/04

[52] U.S. Cl. ..... 249/91; 249/95; 249/97; 249/183

[58] Field of Search ..... 249/91, 95, 97, 249/183

[56] References Cited

U.S. PATENT DOCUMENTS

| | | | |
|---|---|---|---|
| 4,087,947 | 5/1978 | Turner | 52/125 |
| 4,296,909 | 10/1981 | Haeussler | 249/94 |
| 4,383,674 | 5/1983 | Fricker | 249/177 |
| 4,726,562 | 2/1988 | Courtois et al. | 249/91 |
| 4,807,843 | 2/1989 | Courtois et al. | 249/61 |
| 4,821,994 | 4/1989 | Fricker | 249/91 |
| 5,004,208 | 4/1991 | Domizio | 249/91 |
| 5,535,979 | 7/1996 | Ellis-Callow | 249/94 |
| 5,651,911 | 7/1997 | Pennypacker | 249/94 |

OTHER PUBLICATIONS

Dayton Superior, Tilt–up Construction Handbook, 1990, pp. 12–14, 30–35.

Dayton Superior, Precast–Prestressed Concrete Handbook, 1986, pp. 35–39.

*Primary Examiner*—James P. Mackey

*Attorney, Agent, or Firm*—Biebel & French

[57] ABSTRACT

A removable anchor positioning insert for forming a recess in a face of a concrete structure and for the simultaneous positioning of an anchor within the recess. The insert includes a resilient body having an upper surface connected to an arcuate lower surface by front and rear surfaces. An anchor placement channel extends within the body intermediate the upper face and the lower surface and includes a channel apex connecting first and second receiving bores. The first and second receiving bores extend in a downward direction from the channel apex toward the lower surface and include front and rear outlets opening adjacent the front and rear surfaces. A slot extends downwardly from the placement channel to the lower surface. The first and second receiving bores include engagement surfaces for engaging outer surfaces of first and second legs of the anchor. The first and second legs of the anchor extend downwardly from an anchor apex. Front and rear stabilizing wings extend outwardly from the front and rear surfaces of the body and are disposed adjacent the front and rear outlets of the placement channel. Front and rear bearing surfaces are defined by the front and rear stabilizing wings proximate the front and rear outlets for engaging side surfaces of the anchor thereby preventing rotational movement therebetween.

15 Claims, 9 Drawing Sheets

18
20
10
22
84
82
24
80
16
42
40
14
26
28
64
58
12
62
66
68
69

20
20
24
38
82
10
50
42
88
22
92
28
26
34
32
40
36
58
96
96
12
68
62
69

20
20
74
70
24
38
72
82
10
76
50
42
88
22
92
28
26
34
32
40
36
58
96
96
12
68
62
69

ANCHOR POSITIONING INSERT

BACKGROUND OF THE INVENTION

1. Field of the Invention

The present invention relates to an apparatus for use in forming concrete members and, more particularly, to an anchor positioning insert for forming a recess in a face of a concrete member and for the simultaneous positioning of an anchor within the recess.

2. Description of the Prior Art

It is well known in the art to use recessed anchors which are engagable with external hoisting devices for the manipulation of prefabricated concrete structures. More particularly, the concrete structures may be moved from place to place through the utilization of conventional lifting hooks which engage the recessed anchors. The recessed arrangement of the anchor eliminates the need for a subsequent anchor cutting operation after the concrete structure has been hoisted to its intended location.

Various arrangements have been proposed for positioning anchors within recesses in the face of a concrete structure. One such arrangement is disclosed in U.S. Pat. No. 5,004,208 to Domizio. This patent discloses a removable recess forming insert, commonly called a "void", which is adapted for emersion in wet concrete. A stirrup is positioned within the concrete structure by the insert, which is removed after the concrete hardens. However, this insert is suitable for use only where its mold thumb protrudes from a concrete structure and cannot be attached to a planar plate forming part of the mold formwork of the concrete structure. Additionally, no provisions are provided in the Domizio insert for restraining the stirrup from lateral or rotational movement relative to the insert.

Another prior art removable insert is disclosed in U.S. Pat. No. 5,651,911 to Pennypacker. While the Pennypacker insert may be mounted flush to a plate defining part of the mold formwork, no provisions are provided for restraining the anchor from lateral and rotational movement relative to the insert. As such, the anchor may shift within the insert prior to the hardening of the concrete structure wherein the anchor's final fixed position within the concrete structure is not appropriate for engagement with a lifting hook.

Accordingly, there is a need for an anchor positioning insert for forming a recess within a concrete structure while simultaneously securely positioning an anchor within the recess in a manner preventing rotational and lateral movement of the anchor relative to the insert.

SUMMARY OF THE INVENTION

The present invention comprises an apparatus for use in the forming of concrete structures. The apparatus comprises an anchor positioning insert, or "void", for forming a recess in a face of a concrete structure and for the simultaneous positioning of an anchor within the recess.

The anchor positioning insert comprises a resilient body having an upper surface, an arcuate lower surface, and front and rear surfaces connecting the upper surface with the lower surface. An anchor placement channel extends within the body intermediate the upper surface and the lower surface. The anchor placement channel includes a channel apex and first and second receiving bores extending in a downward direction from the channel apex toward the lower surface. The first and second receiving bores include front and rear outlets at ends opposing the channel apex and opening adjacent the front and rear surfaces, respectively.

A slot extends downwardly from the placement channel to the lower surface. Front and rear stabilizing wings extend outwardly from the front and rear surfaces of the body. The stabilizing wings include outer surfaces and front and rear bearing surfaces extending inwardly from the outer surfaces adjacent the front and rear outlets of the placement channel.

The anchor is adapted for lifting the concrete structure and includes an elongated member having an anchor apex and first and second legs extending downwardly on opposing sides of the anchor apex. The outer surfaces of the first and second legs of the anchor are engagable with engagement surfaces of the first and second receiving bores for preventing lateral movement of the anchor between the front and rear surfaces of the insert. The front and rear bearing surfaces of the stabilizing wings are adapted for engagement with side surfaces of the anchor positioned within the placement channel, thereby preventing rotational movement of the anchor relative to the placement channel.

Therefore, it is an object of the present invention to provide an apparatus for forming a recess in a concrete structure and for simultaneously positioning an anchor in the recess.

It is a further object of the present invention to provide an anchor positioning insert which is inexpensive and reusable.

It is another object of the present invention to provide an anchor positioning insert having a structure cooperating with an anchor for preventing movement of the anchor relative to the insert.

It is yet another object of the present invention to provide an anchor positioning insert having a structure facilitating the mounting thereof to plates forming part of a mold formwork of a concrete structure.

It is a further object of the present invention to provide such an anchor positioning insert having a structure which forces the body closed around the anchor when the insert is mounted to a formwork plate.

Other objects and advantages of the invention will be apparent from the following description, the accompanying drawings and the appended claims.

DETAILED DESCRIPTION OF THE PREFERRED EMBODIMENT

Figure 1:
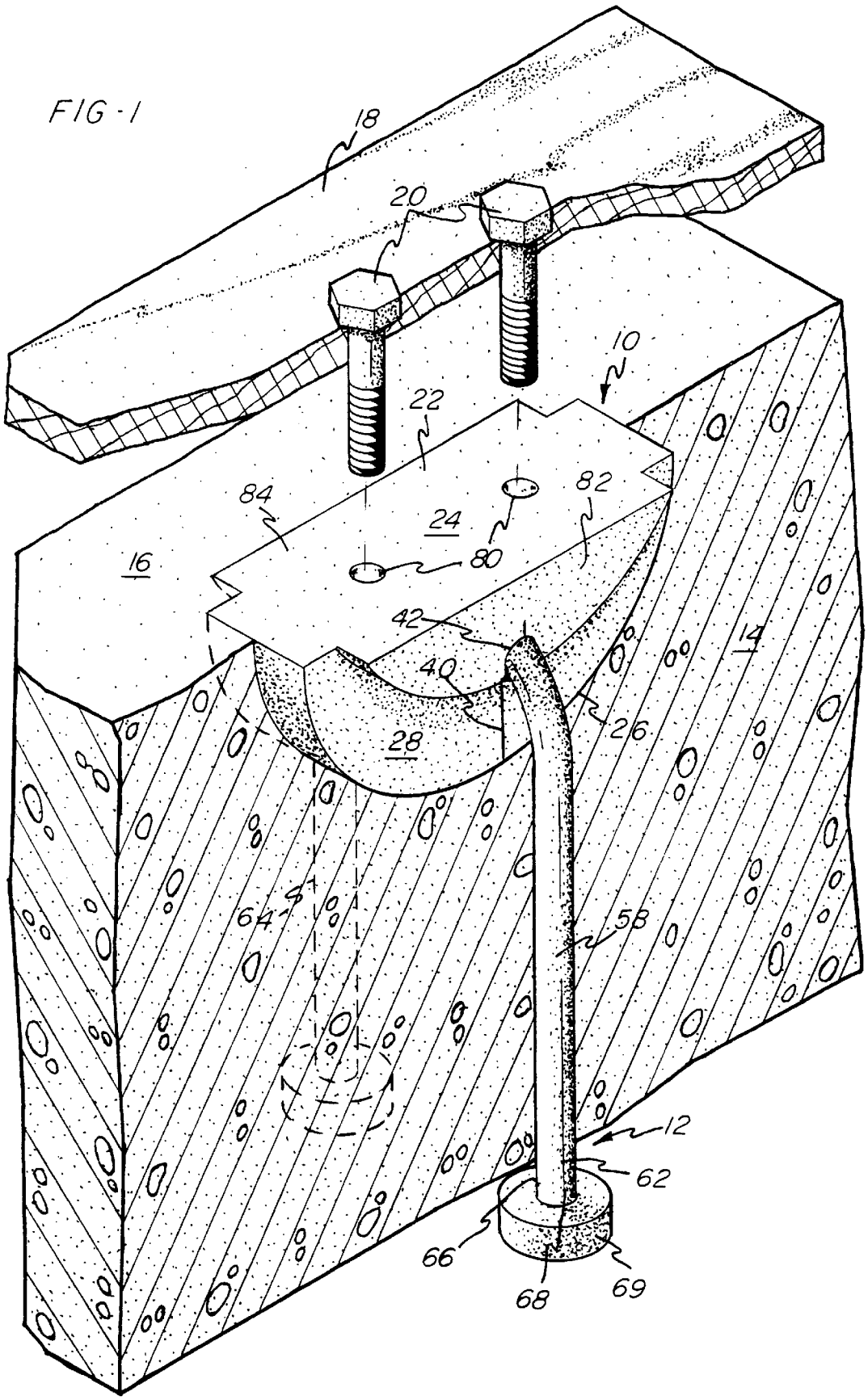
FIG. 1 is a perspective view in partial section of the insert and anchor of the present invention embedded within a concrete structure.

Referring initially to FIG. 1 of the drawings, the anchor positioning insert 10 of the present invention is illustrated as locating an anchor 12 within a prefabricated concrete structure 14. The insert 10 is positioned flush with a face 16 of the concrete structure 14 as a result of its attachment to the inner surface of a formwork plate 18. A pair of bolts 20 are threadably received within the anchor 12 and serve to attach the anchor 12 to the plate 18.

Figure 2:
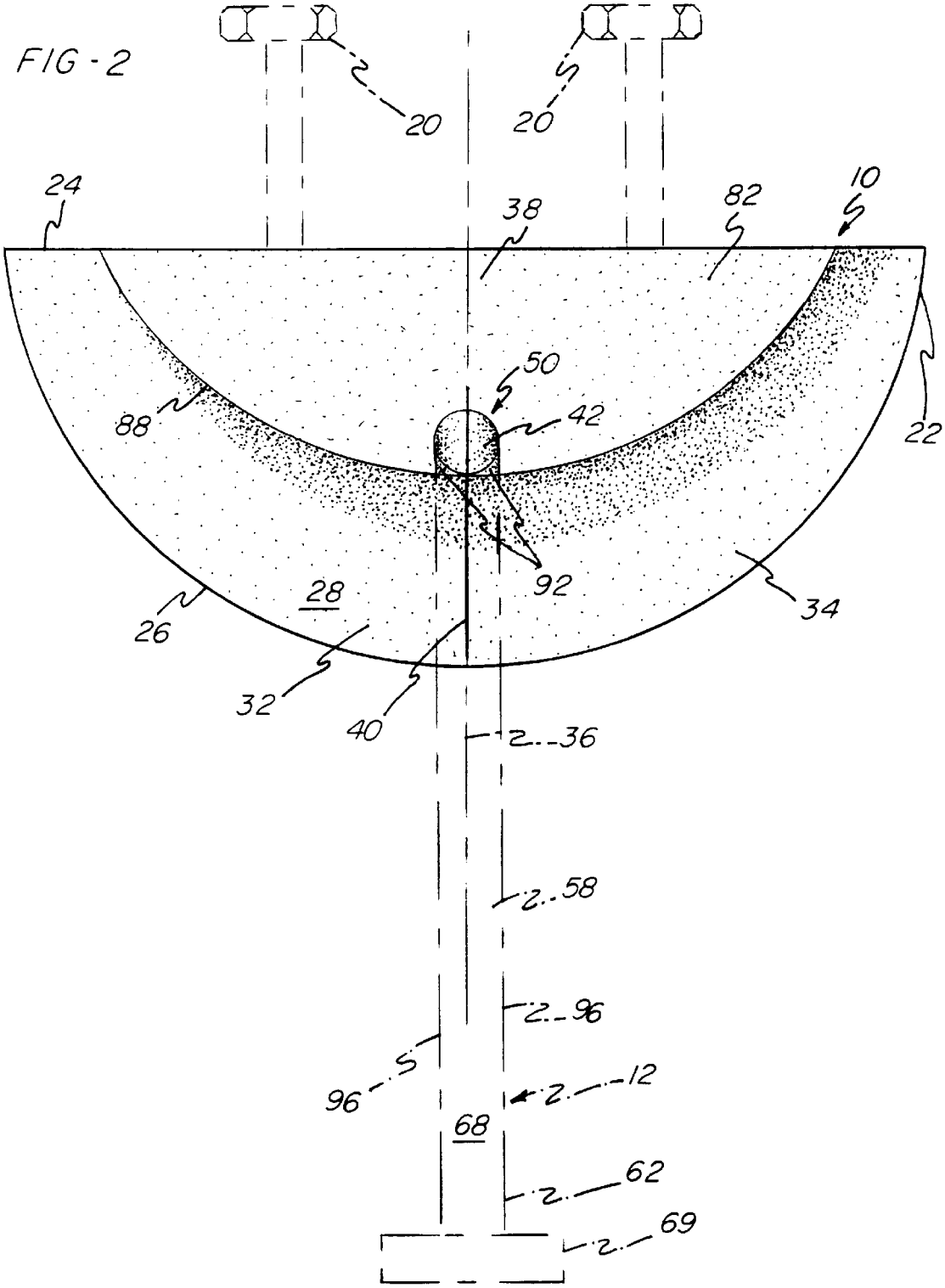
FIG. 2 is a front elevational view of the insert of FIG. 1.
Figure 3:
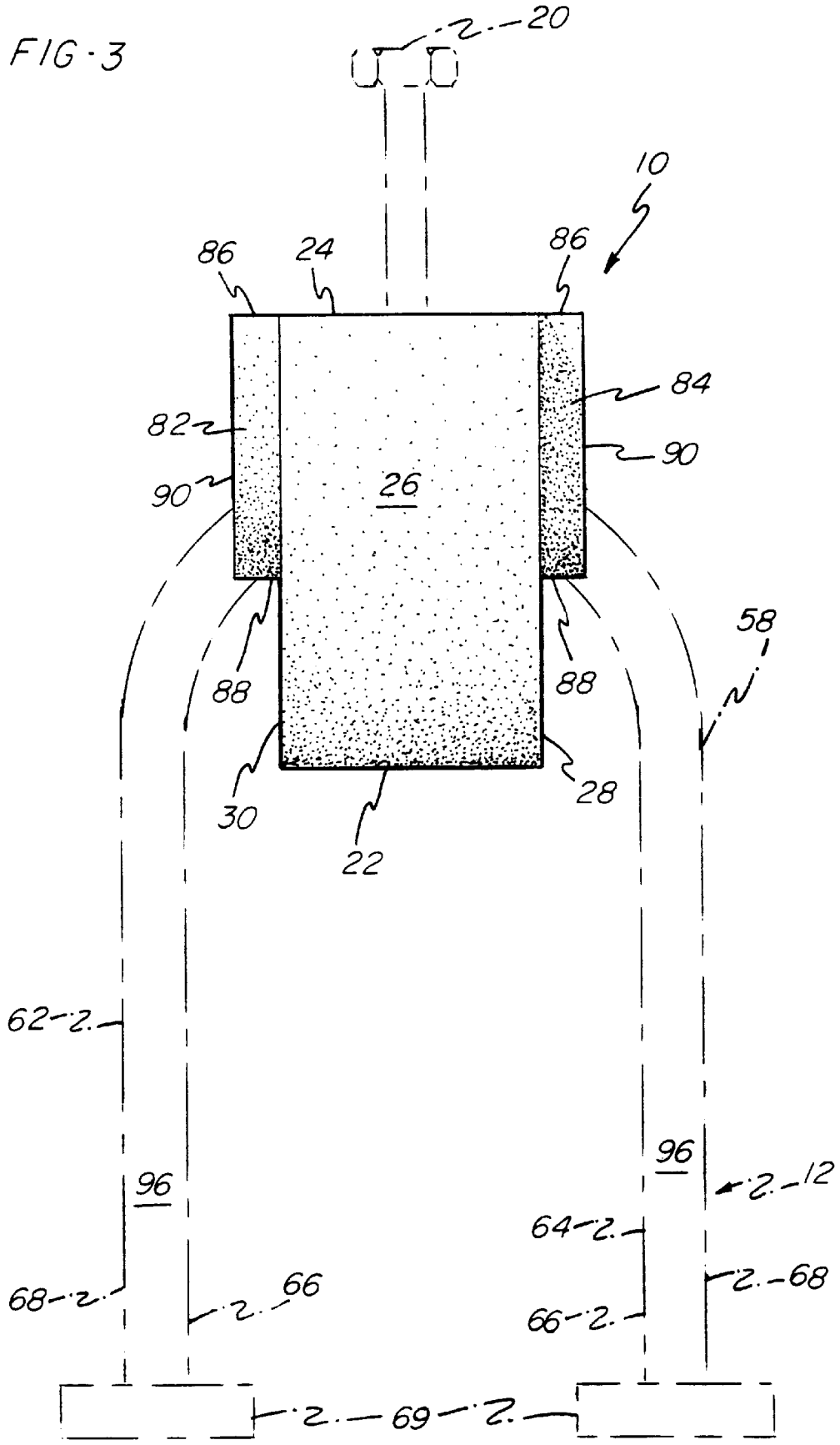
FIG. 3 is a side elevational view of the insert of FIG. 1.
Figure 4:
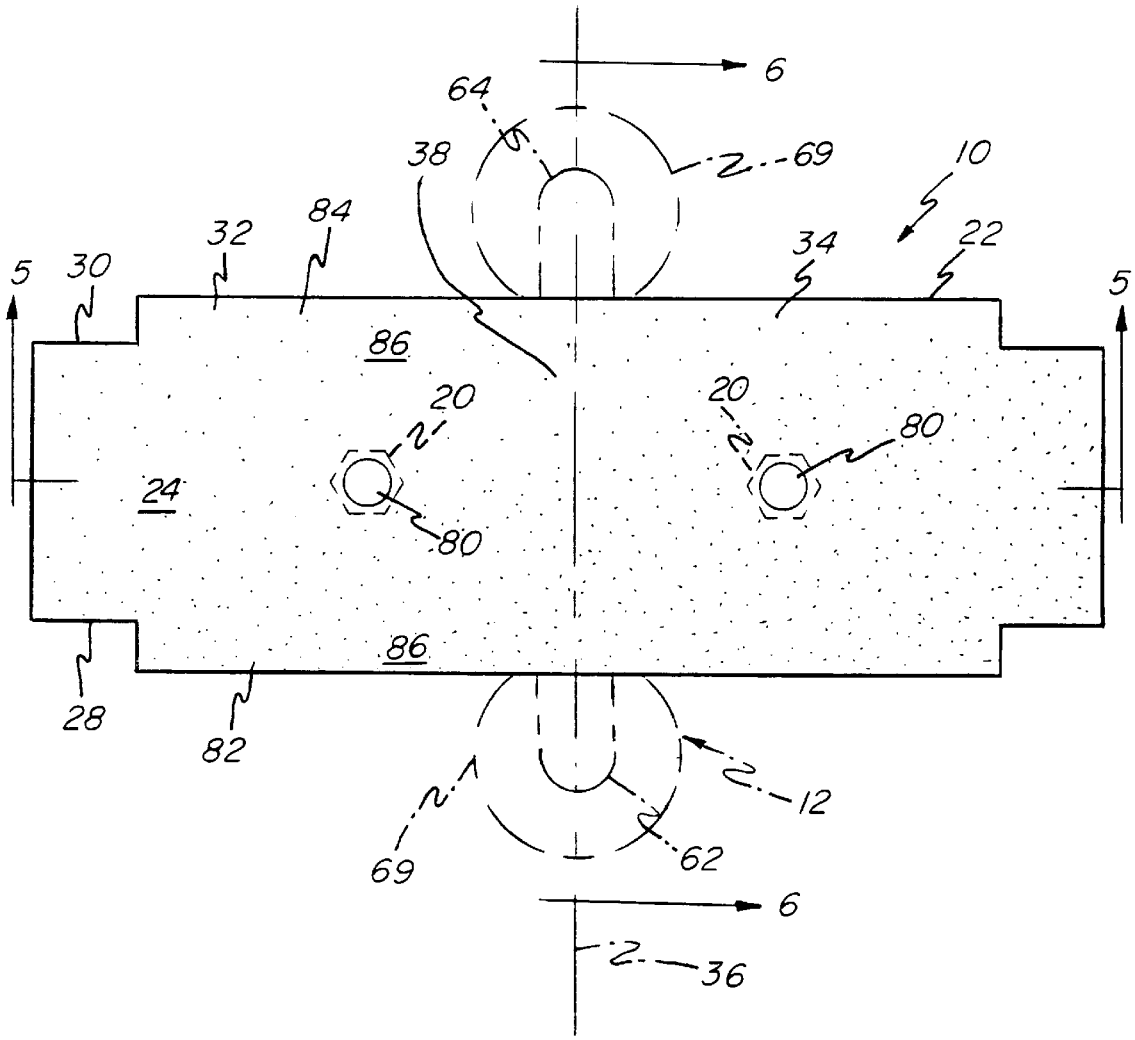
FIG. 4 is a top plan view of the insert of FIG. 1.

Referring further to FIGS. 1–7, the insert 10 includes a resilient body 22 preferably molded from an elastomeric material. The body 22 includes a top surface 24 connected to an arcuate lower surface 26 through front and rear surfaces 28 and 30. The front and rear surfaces 28 and 30 may taper inwardly from the top surface 24 to the lower surface 26 to facilitate easy removal of the insert 10 from the concrete structure 14. The body 22 comprises first and second body portions 32 and 34 symmetrically disposed on opposite sides of a center plane 36 (FIGS. 2 and 4). A hinge portion 38 is centrally disposed proximate the top surface 24 and intersects the center plane 36. The hinge portion 38 facilitates the separation of the first and second body portions 32 and 34 about a slot 40 as will be described in greater detail below.

Figure 6:
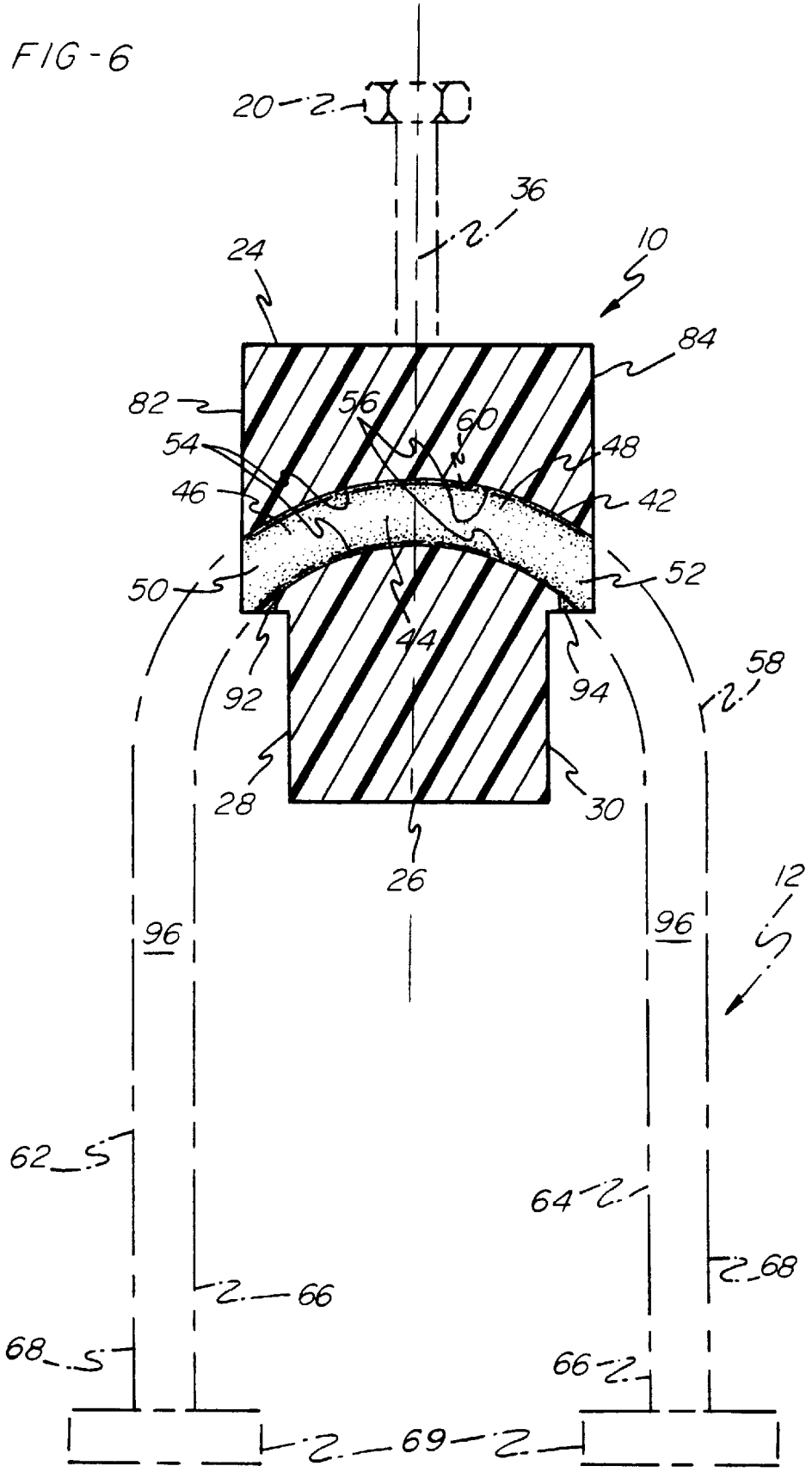
FIG. 6 is a cross-sectional view taken along line 6—6 of FIG. 4.

The slot 40 extends downwardly from an anchor placement channel 42 to the lower surface 26. The anchor placement channel 42 is aligned with the center plane 36 directly below the hinge portion 38. The placement channel 42 includes a channel apex 44 and downwardly extending first and second receiving bores 46 and 48 (FIG. 6). The placement channel 42 extends through the anchor insert 10 between the front and rear surfaces 28 and 30 and intermediate the top and lower surfaces 24 and 26. The first bore 46 has a first end proximate the channel apex 44 and a second end defining a front outlet 50 adjacent the front surface 28. Likewise, the second bore 48 has a first end proximate the channel apex 44 and a second end defining a rear outlet 52 adjacent the rear surface 30. Both the first and second bores 46 and 48 have inner surfaces defining first and second engagement surfaces 54 and 56 respectively.

Referring further to FIGS. 1 and 6, the anchor 12 has a structure adapted to mate with the placement channel 42 for preventing movement between the anchor 12 and insert 10. More particularly, the anchor 12 comprises an elongated member 58 including an anchor apex 60 and preferably made of steel. First and second legs 62 and 64 extend downwardly in spaced relation to each other from the anchor apex 60. Both the first and second legs 62 and 64 include an inwardly facing outer surface 66 and an outwardly facing outer surface 68 for engaging the first and second engagement surfaces 54 and 56 of the first and second bores 46 and 48. As may be readily appreciated, lateral movement of the anchor 12 in a direction perpendicular to the center plane 36 is prevented by engagement between the surfaces 66 and 68 of the first and second legs 62 and 64 and the first and second engagement surfaces 54 and 56 of the first and second receiving bores 46 and 48.

While the anchor 12 is illustrated as having a U-shape, it should be appreciated that other similar shapes having an apex 60 and legs 62 and 64 may be readily substituted therefor including V-shaped anchors. Retaining members 69 are fixed to the ends of each leg 62 and 64. The retaining members 69 have a larger cross-sectional area than the respective legs 62 and 64 for facilitating engagement and retention of the anchor 12 within the concrete structure 14.

As illustrated in FIGS. 1–4, the placement channel 42 is preferably disposed for orienting the anchor 12 symmetrically in a vertical direction along the center plane 36. However, the placement channel 42 may be rotated about its own longitudinal axis such that the anchor 12 is oriented at an angle from vertical. More particularly, the anchor 12 may be oriented such that the first and second legs 62 and 64 are disposed at a predetermined angle, preferably 45°, from the center plane 36. As such, the anchor 12 may be positioned in a shallower concrete structure 14. Additionally, positioning of the anchor 12 at an angle from vertical facilitates the application of a lifting load to the anchor 12 which includes a horizontal portion acting parallel to the face 16 of the concrete structure 14. Such horizontal portion of the lifting load thereby acts as a substantially tensile force on the anchor 12.

Figure 8:
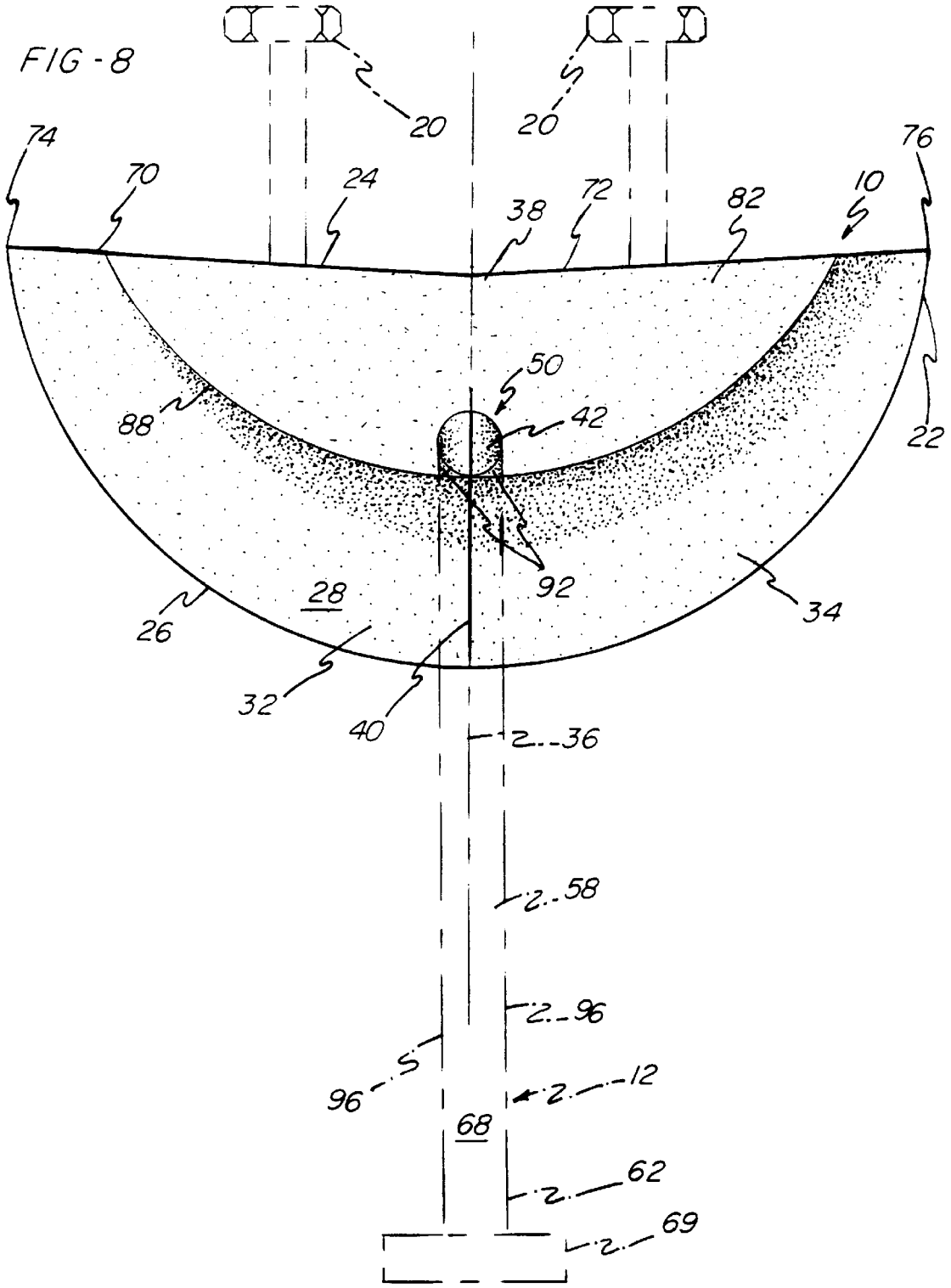
FIG. 8 is a side elevational view of an alternative embodiment of the insert of the present invention.

In order to facilitate closure of the slot 40 by the first and second body portion 32 and 34, the top surface 24 preferably includes first and second inclined surfaces 70 and 72 symmetrically disposed on opposite sides of the center plane 36 as illustrated in FIG. 8. The inclined surfaces 70 and 72 extend downwardly to the center plane 36 from first and second edges 74 and 76 connecting the surfaces 70 and 72 with the arcuate lower surface 26. As may be appreciated, when the insert 10 is fixed to a planar formwork plate 18, the first and second body portions 32 and 34 pivot downwardly about the hinge portion 38 thereby forcing the slot 40 closed.

Figure 5:
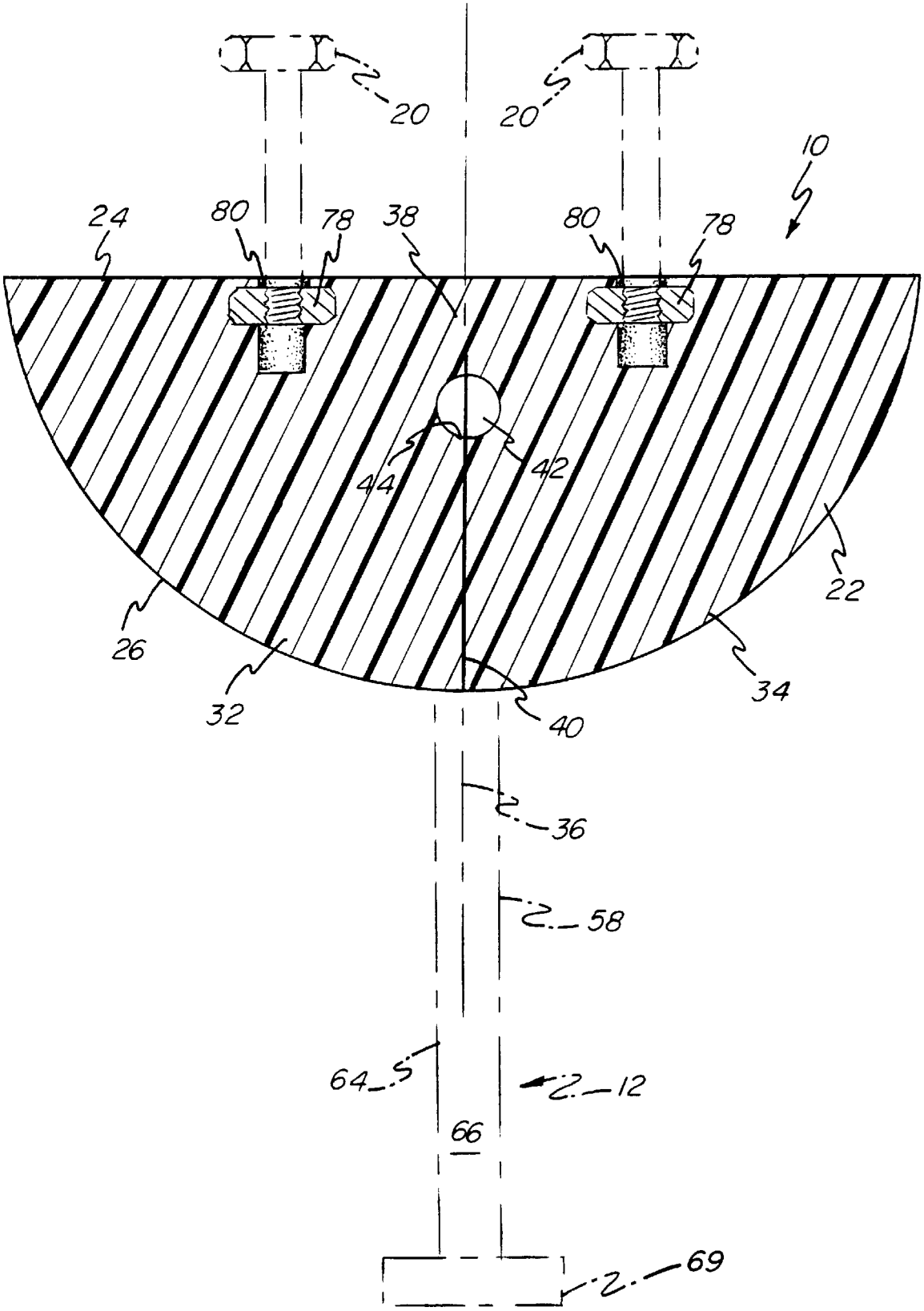
FIG. 5 is a cross-sectional view taken along line 5—5 of FIG. 4.

Referring further to FIG. 5, a pair of threaded inserts 78 are disposed within a pair of apertures 80 and extend downwardly from the top surface 24 of the body 22. The apertures 80 are positioned symmetrically on opposite sides of the center plane 36. One aperture 80 is located within the first body portion 32 and one aperture 80 is disposed within the second body portion 34. As described above, bolts 20 are utilized to secure the insert 10 to the formwork plate 18 as a preferred method of attachment. Each bolt 20 is threadably received within one of the inserts 78. However, it should be understood that other means of attaching the insert may be utilized, including but not limited to the use of adhesives and tape.

Figure 9:
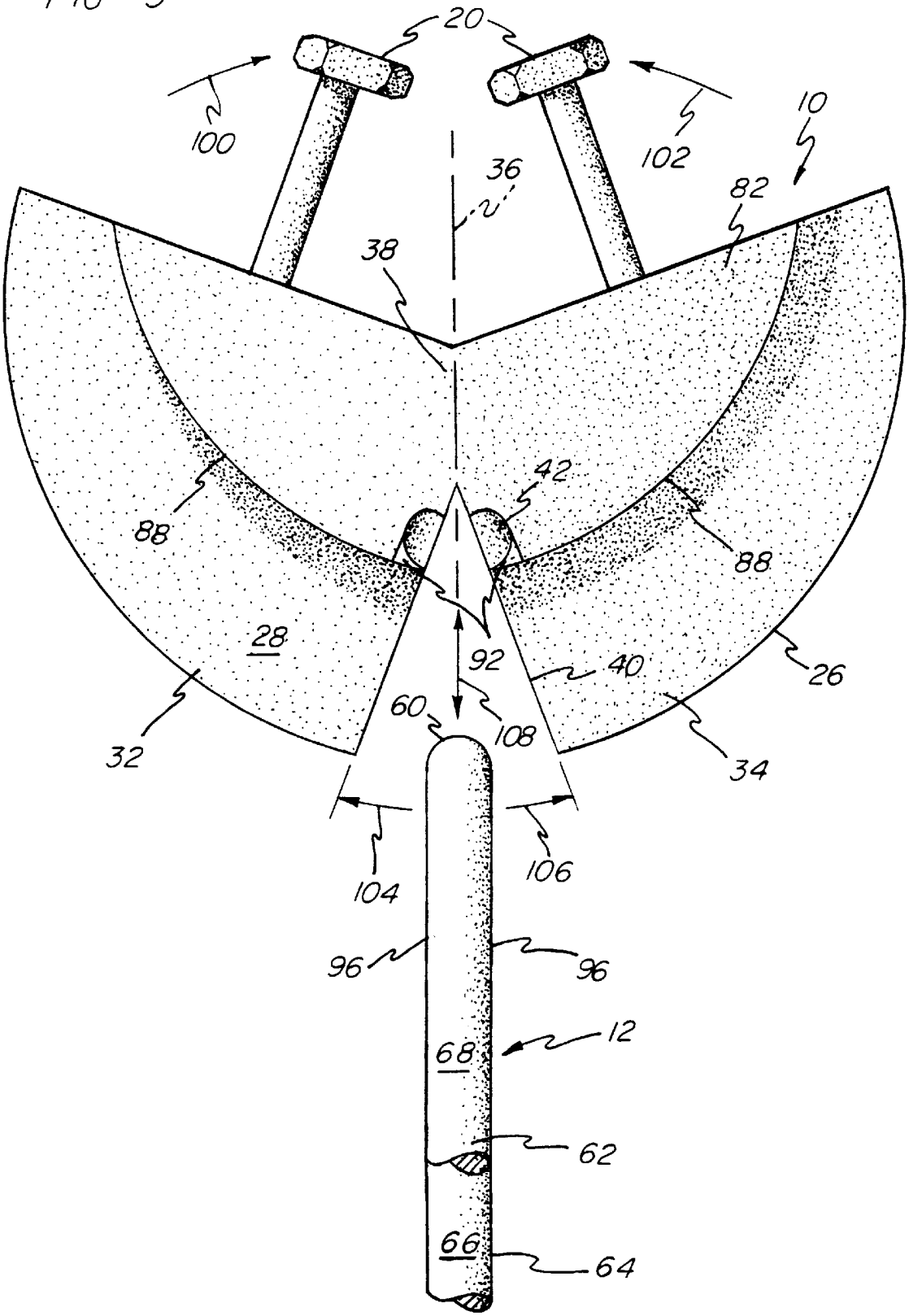
FIG. 9 is a front elevational view of the insert and anchor of the present invention.

Turning now to FIGS. 1 and 9, the bolts 20 are also utilized to assist in the removal of the insert from a newly formed prefabricated concrete structure 14. More particularly, a user may pinch the pair of bolts 20 together such that the first and second body portions 32 and 34 pivot towards each other about the hinge portion 38 thereby opening the slot 40 and permitting removal of the insert 10 from the anchor 12 which is embedded within the hardened concrete structure 14.

Figure 7:
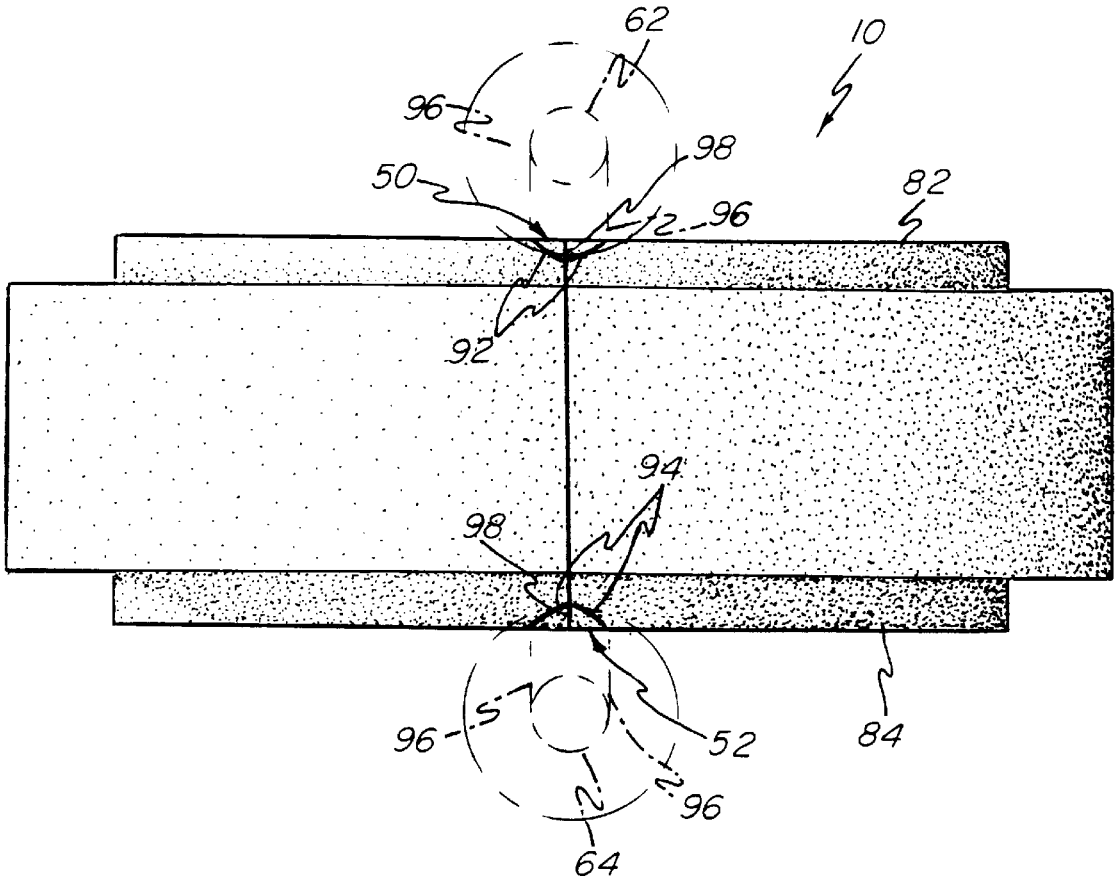
FIG. 7 is a bottom plan view of the insert of FIG. 1.

Referring again to FIGS. 2–7, front and rear stabilizing wings 82 and 84 extend outwardly from the front and rear surfaces 28 and 30 of the body 22. The top surface 86 of each wing 82 and 84 is formed flush with the top surface 24 of the body 22. Each stabilizing wing 82 and 84 further includes an arcuate lower surface 88 connected to its top surface 86 through an outside surface 90. The front and rear stabilizing wings 82 and 84 are disposed adjacent the front and rear outlets 50 and 52 of the placement channel 42. Rear opposing bearing surfaces 92 and front opposing bearing surfaces 94 are defined by the front and rear stabilizing wings 82 and 84 proximate the front and rear outlets 50 and 52 for engaging a side surface 96 of the anchor 12 (FIGS. 2, 6 and 7).

The bearing surfaces 92 and 94 are recessed inwardly towards the center plane 36 from the outside surface 90 of each respective stabilizing wing 82 and 84 thereby providing for engagement with the side surfaces 96 of the anchor 12 when positioned within the placement channel 42. Each of the stabilizing wings 82 and 84 includes a slot 98 extending from the outside surface 90 adjacent a respective bearing surface 92 and 94 inwardly to communicate with the slot 40 of the body 22. As may be appreciated, the slot 98 permits pivoting motion of the first and second body portions 32 and 34 about the hinge portion 38.

Engagement between the bearing surfaces 92 and 94 of the stabilizing wings 82 and 84 and the outer side surfaces 96 of the anchor 12 prevents rotational movement of the anchor 12 relative to the insert 10. Therefore, once the insert 10 is the formwork plate 18, the anchor 12 will not move relative the concrete structure 14.

The operation of the anchor positioning insert 10 and anchor 12 will now be described in greater detail. The anchor 12 is initially inserted within the insert 10 by pinching the bolts 20 towards each other about the hinge portion 38 of the body 22. In response, the slot 40 opens and the elongated member 58 of the anchor 12 is positioned within the placement channel 42. The anchor apex 60 is received within the channel apex 44, while the first and second legs 62 and 64 are received within the first and second receiving bores 46 and 48. Once the anchor 12 is positioned thus, the elongated member 58 is prevented from lateral movement perpendicular to the center plane 36 by engagement between the first and second engagement surfaces 54 and 56 of the first and second bores 46 and 48 and the surfaces 66 and 68 of the first and second legs 62 and 64. Rotational movement of the anchor 12 relative to the anchor 10 is prevented by engagement between the front and rear bearing surfaces 92 and 94 of the front and rear stabilizing wings 82 and 84 and the outer side surfaces 96 of the anchor 12.

The insert 10 is then bolted to a formwork plate 18 through the pair of bolts 20 which are threadably received within the thread inserts 78 disposed below the top surface 24. The flat lower surface of the formwork plate 18 forces the first and second edges 74 and 76 of the first and second inclined surfaces 70 and 72 in a downward direction thereby forcing the first and second body portions 32 and 34 to close the slot 40.

After the formwork plate 18 is properly positioned with the insert 10 and the anchor 12 is attached thereto, wet concrete is poured into a mold defined by a plurality of formwork plates 18 which subsequently surrounds the arcuate lower surfaces 26 of the insert 10 and hardens. The formwork plate 18 is thereafter removed, and the bolts 20 are grasped and pinched towards each other as indicated by arrows 100 and 102 in FIG. 9. Force exerted on the bolts 20 causes the first and second body portions 32 and 34 to pivot about the hinge portion 38 thereby opening the slot 40 as indicated by arrows 104 and 106. The arcuate lower surface 26 permits pivoting movement of the body portions 32 and 34 within the newly formed concrete structure 14. After the slot 40 and 98 are opened, the insert 10 may be pulled upwardly out of engagement with the anchor 12 as indicated by arrow 108. The anchor 12 remains fixed within the newly hardened concrete structure 14 within a newly formed recess and provides a lifting point for subsequent manipulation and movement of the concrete structure 14.

Therefore, it may be seen that the present invention provides an anchor positioning insert for securely holding an anchor within a concrete structure as it is being formed. The anchor positioning insert prevents both lateral and rotational movement of the anchor relative to the body of the insert thereby ensuring the proper location and orientation of the anchor within the hardened concrete structure.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An apparatus for forming concrete structures, said apparatus comprising:

an anchor positioning insert including a resilient body having first and second body portions, a hinge portion connecting said first and second body portions, an upper surface, an arcuate lower surface, and front and rear surfaces connecting said upper surface and said lower surface;

an anchor placement channel extending within said body intermediate said upper surface and said lower surface, said anchor placement channel including a channel apex and first and second receiving bores extending in a downward direction from said channel apex toward said lower surface, said first and second receiving bores having ends opposite said channel apex and defining front and rear outlets;

a slot defined by said first and second body portions and extending downwardly from said placement channel to said lower surface; and an anchor adapted for lifting a concrete structure and received within said anchor placement channel, said anchor including an elongated member having an anchor apex and first and second legs extending downwardly on opposing sides of said anchor apex.

2. The apparatus of claim 1 wherein:

said first and second receiving bores include engagement surfaces;

said first and second legs include outer surfaces; and said engagement surfaces of said first and second receiving bores are engagable with said outer surfaces of said first and second legs for preventing movement of said anchor between said front and rear surfaces of said anchor positioning insert.

3. The apparatus of claim 1 wherein said anchor further comprises first and second enlarged retaining members fixed to said first and second legs for securing said anchor within a concrete structure.

4. The apparatus of claim 1 further comprising a securing device for releasably attaching said upper surface of said anchor positioning insert to a concrete form.

5. The apparatus of claim 1 wherein said body further comprises front and rear stabilizing wings extending outwardly from said front and rear surfaces of said body, said front and rear stabilizing wings disposed adjacent said front and rear outlets of said placement channel.

6. The apparatus of claim 5 wherein said front and rear stabilizing wings define front and rear bearing surfaces proximate said front and rear outlets for engaging a side surface of said anchor thereby preventing rotational movement of said anchor.

7. The apparatus of claim 1 wherein said top surface includes first and second inclined surfaces, each of said first and second inclined surfaces extending downwardly towards said hinge portion wherein forces exerted against said inclined surfaces press said slot within said body closed.

8. An anchor positioning insert for forming a recess in a face of a concrete structure and for the simultaneous positioning of an anchor within said recess, said anchor positioning insert comprising:

a resilient body including first and second body portions, and a hinge portion connecting said first and second body portions, said body having an upper surface, an arcuate lower surface, and front and rear surfaces connecting said upper surface and said lower surface;

an anchor placement channel extending within said body intermediate said upper surface and said lower surface, said anchor placement channel having opposing inlet and outlet ends;

a slot defined by said first and second body portions and extending downwardly from said placement channel to said lower surface; and front and rear stabilizing wings extending outwardly from said front and rear surfaces of said body, said stabilizing wings disposed adjacent said front and rear outlets of said placement channel.

9. The anchor positioning insert of claim 8 wherein said front and rear stabilizing wings include front and rear bearing surfaces proximate said front and rear outlets of said placement channel, said bearing surfaces adapted for engaging a side surface of an anchor positioned within said placement channel thereby preventing rotational movement of said anchor.

10. The anchor positioning insert of claim 9 wherein:

said front and rear stabilizing wings each include outside surfaces; and said bearing surfaces extend inwardly from said outside surfaces of said stabilizing wings toward said body for engagement with said side surface of the anchor positioned within said placement channel.

11. The anchor positioning insert of claim 9 wherein each of said stabilizing wings includes a slot extending from one of said outside surfaces inwardly into communication with said slot in said body section.

12. The anchor positioning insert of claim 8 wherein said top surface includes first and second inclined surfaces extending downwardly towards said hinge portion wherein forces exerted against said inclined surfaces press said slot within said body closed.

13. The anchor positioning insert of claim 9 wherein said placement channel includes a channel apex and first and second receiving bores extending in a downward direction from said channel apex toward said inlet and outlet ends.

14. The anchor positioning insert of claim 13 wherein:

said first and second receiving bores include first and second engagement surfaces; and said engagement surfaces of said first and second receiving bores are engagable with an outer surface of an anchor received within said anchor placement channel for preventing movement of the anchor between said front and rear surfaces of said body.

15. An anchor positioning insert for forming a recess in a face of a concrete structure and for the simultaneous positioning of an anchor within the recess, said anchor positioning insert comprising:

a resilient body having an upper surface, an arcuate lower surface, and front and rear surfaces connecting said upper surface and said lower surface;

an anchor placement channel extending within said body intermediate said upper surface and said lower surface, said anchor placement channel including a channel apex and first and second receiving bores extending in a downward direction from said channel apex toward said lower surface, said first and second receiving bores having ends opposite said channel apex and defining front and rear outlets;

a slot extending downwardly from said placement channel to said lower surface;

front and rear stabilizing wings extending outwardly from said front and rear surfaces of said body, each of said stabilizing wings including an outer surface and a bearing surface extending inwardly from said outer surface adjacent one of said front and rear outlets of said placement channel; and wherein each said bearing surface is adapted for engagement with a side surface of an anchor positioned within said placement channel thereby preventing rotational movement of the anchor within said placement channel.

* * * * *

US006082700C1

(12) REEXAMINATION CERTIFICATE (4768th)

United States Patent

Lancelot, III et al.

(10) Number: US 6,082,700 C1

(45) Certificate Issued: Apr. 15, 2003

(54) ANCHOR POSITIONING INSERT

(75) Inventors: Harry Bailey Lancelot, III, Hurst, TX (US); Larry Gene Vines, Burleson, TX (US)

(73) Assignee: Dayton Superior Corporation, Miamisburg, OH (US)

Reexamination Request:
No. 90/006,158, Dec. 11, 2001

Reexamination Certificate for:

| | |
|---|---|
| Patent No.: | **6,082,700** |
| Issued: | **Jul. 4, 2000** |
| Appl. No.: | **09/213,211** |
| Filed: | **Dec. 17, 1998** |

(51) Int. Cl.[7] ..... E04G 15/04

(52) U.S. Cl. ..... 249/91; 249/95; 249/97; 249/183

(58) Field of Search ..... 249/91, 95, 97, 249/183

(56) References Cited

U.S. PATENT DOCUMENTS

| | | | | | |
|---|---|---|---|---|---|
| 4,087,947 | A | * | 5/1978 | Turner | 52/125 |
| 4,296,909 | A | * | 10/1981 | Haeussler | 249/94 |
| 4,383,674 | A | * | 5/1983 | Fricker | 249/177 |
| 4,726,562 | A | * | 2/1988 | Courtois et al. | 249/91 |
| 4,807,843 | A | * | 2/1989 | Courtois et al. | 249/61 |
| 4,821,994 | A | * | 4/1989 | Fricker | 249/91 |
| 4,930,269 | A | | 6/1990 | Kelly et al. | 52/125.5 |
| 5,004,208 | A | * | 4/1991 | Domizio | 249/91 |
| 5,535,979 | A | * | 7/1996 | Ellis-Callow | 249/94 |
| 5,651,911 | A | * | 7/1997 | Pennypacker | 240/94 |

OTHER PUBLICATIONS

Page from Pfeifer pamphlet dated Feb. 1994.*

Page from Meadow Burke pamphlet date unknown.*

Page from United Rentals date unknown.*

4 pages from Universal form clamp co. date unknown.*

* cited by examiner

*Primary Examiner*—Tim Heitbrink

(57) ABSTRACT

A removable anchor positioning insert for forming a recess in a face of a concrete structure and for the simultaneous positioning of an anchor within the recess. The insert includes a resilient body having an upper surface connected to an arcuate lower surface by front and rear surfaces. An anchor placement channel extends within the body intermediate the upper face and the lower surface and includes a channel apex connecting first and second receiving bores. The first and second receiving bores extend in a downward direction from the channel apex toward the lower surface and include front and rear outlets opening adjacent the front and rear surfaces. A slot extends downwardly from the placement channel to the lower surface. The first and second receiving bores include engagement surfaces for engaging outer surfaces of first and second legs of the anchor. The first and second legs of the anchor extend downwardly from an anchor apex. Front and rear stabilizing wings extend outwardly from the front and rear surfaces of the body and are disposed adjacent the front and rear outlets of the placement channel. Front and rear bearing surfaces are defined by the front and rear stabilizing wings proximate the front and rear outlets for engaging side surfaces of the anchor thereby preventing rotational movement therebetween.

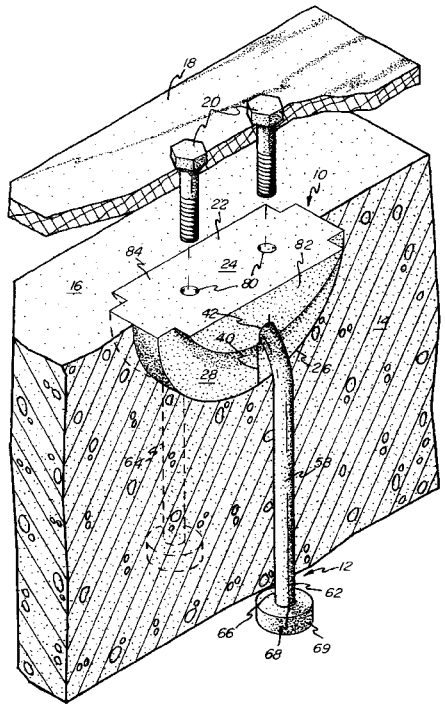

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8–15 is confirmed.

Claims 2 and 6 are cancelled.

Claims 1 and 5 are determined to be patentable as amended.

Claims 3, 4 and 7, dependent on an amended claim, are determined to be patentable.

1. An apparatus for forming concrete structures, said apparatus comprising:

an anchor positioning insert including a resilient body having first and second body portions, a hinge portion connecting said first and second body portions, an upper surface, an arcuate lower surface, and front and rear surfaces connecting said upper surface and said lower surface;

an anchor placement channel extending within said body intermediate said upper surface and said lower surface, said anchor placement channel including a channel apex and first and second receiving bores extending in a downward direction from said channel apex toward said lower surface, said first and second receiving bores having *internal engagement surfaces and* ends opposite said channel apex and defining front and rear outlets;

*front and rear opposing bearing surfaces formed on said insert;* a slot defined by said first and second body portions and extending downwardly from said placement channel to said lower surface; and an anchor adapted for lifting a concrete structure and received within said anchor placement channel, said anchor including an elongated member having an anchor apex and first and second legs extending downwardly on opposing sides of said anchor apex*;*

*said first and second legs having outer surfaces in engagement with said internal engagement surfaces of said first and second receiving bores for preventing lateral movement of said anchor between said front and rear surfaces of said anchor positioning insert, and side surfaces in engagement with said front and rear opposing bearing surfaces for preventing rotational movement of said anchor.*

5. The apparatus of claim 1 wherein [said body further comprises] *said front and rear opposing bearing surfaces are defined by* front and rear stabilizing wings extending outwardly from said front and rear surfaces of said body, said front and rear stabilizing wings disposed adjacent said front and rear outlets of said placement channel.

* * * * *